US006481412B1

(12) United States Patent
Yiu

(10) Patent No.: US 6,481,412 B1
(45) Date of Patent: Nov. 19, 2002

(54) TARGET BLOCK STRUCTURE OF ELECTRONIC DARTBOARD

(76) Inventor: Chih-Hao Yiu, 7F-1, No. 30, Lin-Shen Rd., Taichung City (TW)

( * ) Notice: Subject to any disclaimer, the term of this patent is extended or adjusted under 35 U.S.C. 154(b) by 10 days.

(21) Appl. No.: 09/846,518

(22) Filed: May 2, 2001

(51) Int. Cl.[7] ..... G08B 23/00
(52) U.S. Cl. ..... 123/374
(58) Field of Search ..... 273/371, 372, 273/373, 374, 375, 376

(56) References Cited

U.S. PATENT DOCUMENTS 4,976,441 A * 12/1990 Kim ..... 273/376
5,519,250 A * 5/1996 Lu et al. ..... 273/347
5,988,646 A * 11/1999 Fair ..... 273/374
6,116,607 A * 9/2000 Cho ..... 273/374
6,215,390 B1 * 4/2001 Lin ..... 340/374

* cited by examiner

*Primary Examiner*—Marguerite McMahon
(74) *Attorney, Agent, or Firm*—Charles E. Baxley

(57) ABSTRACT

A target block structure of an electronic dartboard includes a target block made of hard material having a body whose outer portion is integrally formed with a soft cushioning structure and cushioning ribs. Thus, when the target block is hit by the dart to displace, the soft cushioning structure may reduce the noise due to friction and hitting. In addition, the bottom of the body is provided with a hard trigger column whose end portion is formed with a soft column leg. The column leg has an outside formed with an annular wall and an inside formed with a trigger point. The annular wall may be deformed by an impact force for cushioning the impact force, thereby preventing incurring noise.

7 Claims, 10 Drawing Sheets

TARGET BLOCK STRUCTURE OF ELECTRONIC DARTBOARD

BACKGROUND OF THE INVENTION

1. Field of the Invention

The present invention relates to an improvement of a target block structure of an electronic dartboard, and more particularly to a target block structure of an electronic dartboard, which may reduce noise when the target block is hit by the dart.

2. Description of the Related Art

A conventional target block structure of an electronic dartboard in accordance with the prior art shown in FIG. 1 comprises a target frame 10, a plurality of target blocks 11, a plurality of electronic sensing members 12, and a back plate 13. When the target block 11 is hit by the dart 14, the target block 11 is displaced in the target frame 10 to trigger the electronic sensing member 12 which may induce the scoring state of the dart.

However, when the target block is hit by the dart, the target block is displaced in the target frame, thereby incurring noise due to friction between the target block and the target frame. In addition, the target block is pushed by the impact force of the dart, so that the target block, the electronic sensing member, and the back plate are hit by the impact force, thereby producing noise due to hitting. Further, the target frame is provided with multiple target blocks, and a clearance is formed between the target frame and each target block for allowing sliding of the target block, so that when one target block is hit, other blocks are easily affected by the impact force of the dart to sway and vibrate, thereby incurring noise.

SUMMARY OF THE INVENTION

The present invention has arisen to mitigate and/or obviate the disadvantage of the conventional electronic dartboard.

The primary objective of the present invention is to provide a target block structure of an electronic dartboard, including a target block made of hard material having a body whose outer portion is integrally formed with a soft cushioning structure and cushioning ribs. Thus, when the target block is hit by the dart to displace, the soft cushioning structure may reduce the noise due to friction and hitting. In addition, the bottom of the body is provided with a hard trigger column whose end portion is formed with a soft column leg. The column leg has an outside formed with an annular wall and an inside formed with a trigger point. The annular wall may be deformed by an impact force for cushioning the impact force, thereby preventing incurring noise.

Further benefits and advantages of the present invention will become apparent after a careful reading of the detailed description with appropriate reference to the accompanying drawings.

DETAILED DESCRIPTION OF THE INVENTION

Figure 1:
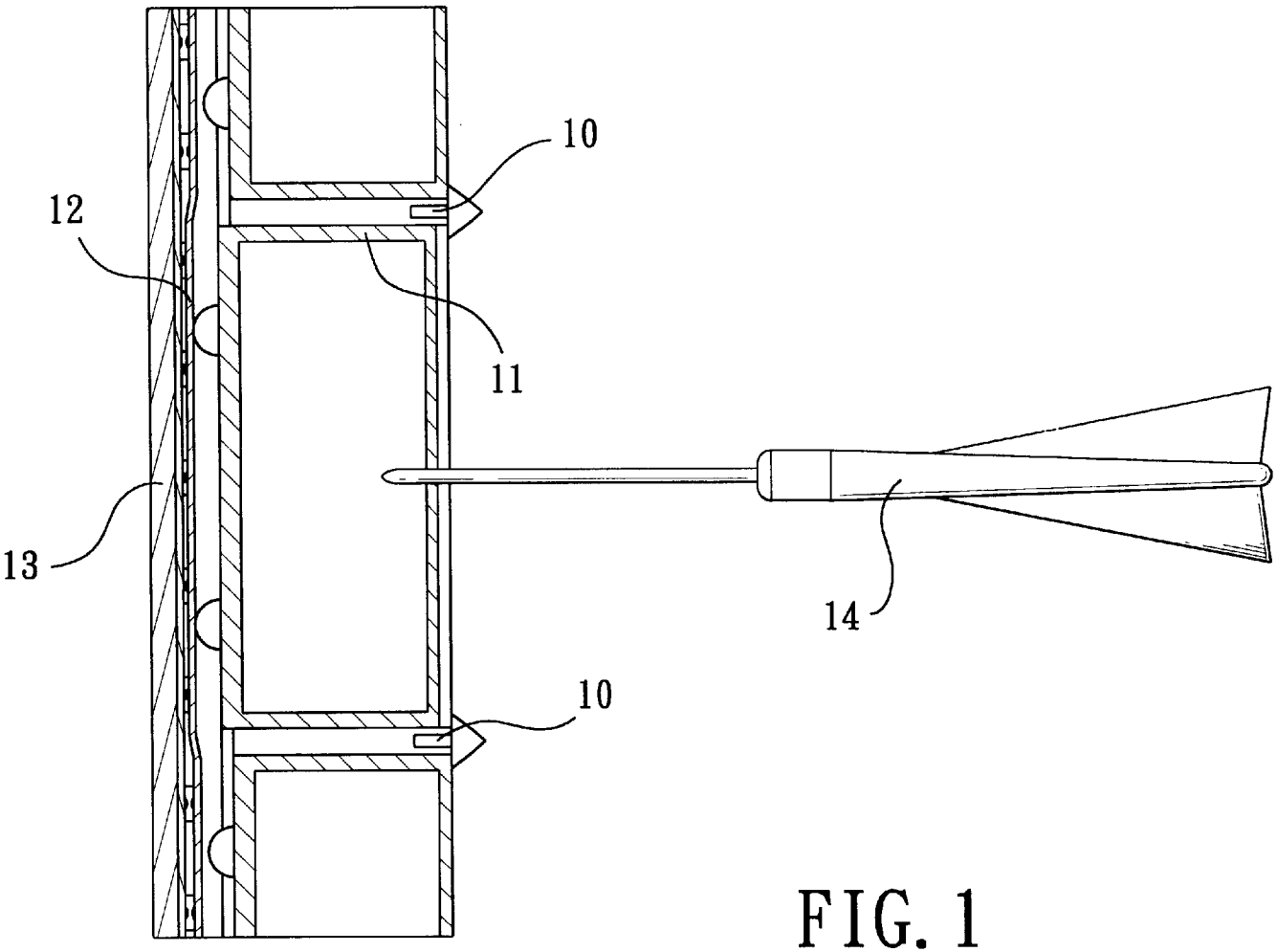
FIG. 1 PRIOR ART
FIG. 1 is a cross-sectional assembly view of a conventional electronic dartboard in accordance with the prior art.
Figure 2:
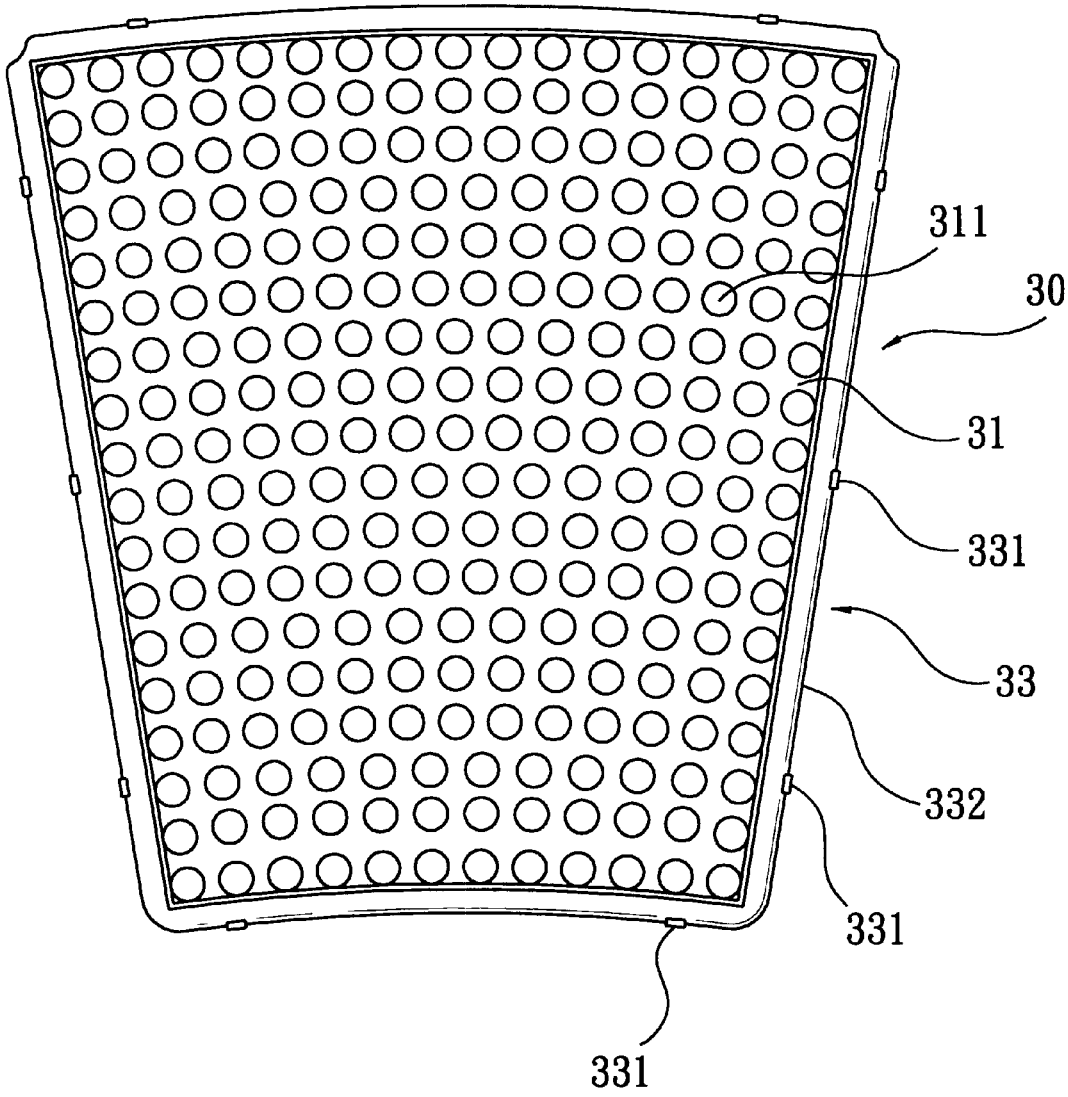
FIG. 2 is a top plan view of a target block structure of an electronic dartboard in accordance with a first embodiment of the present invention.
Figure 3:
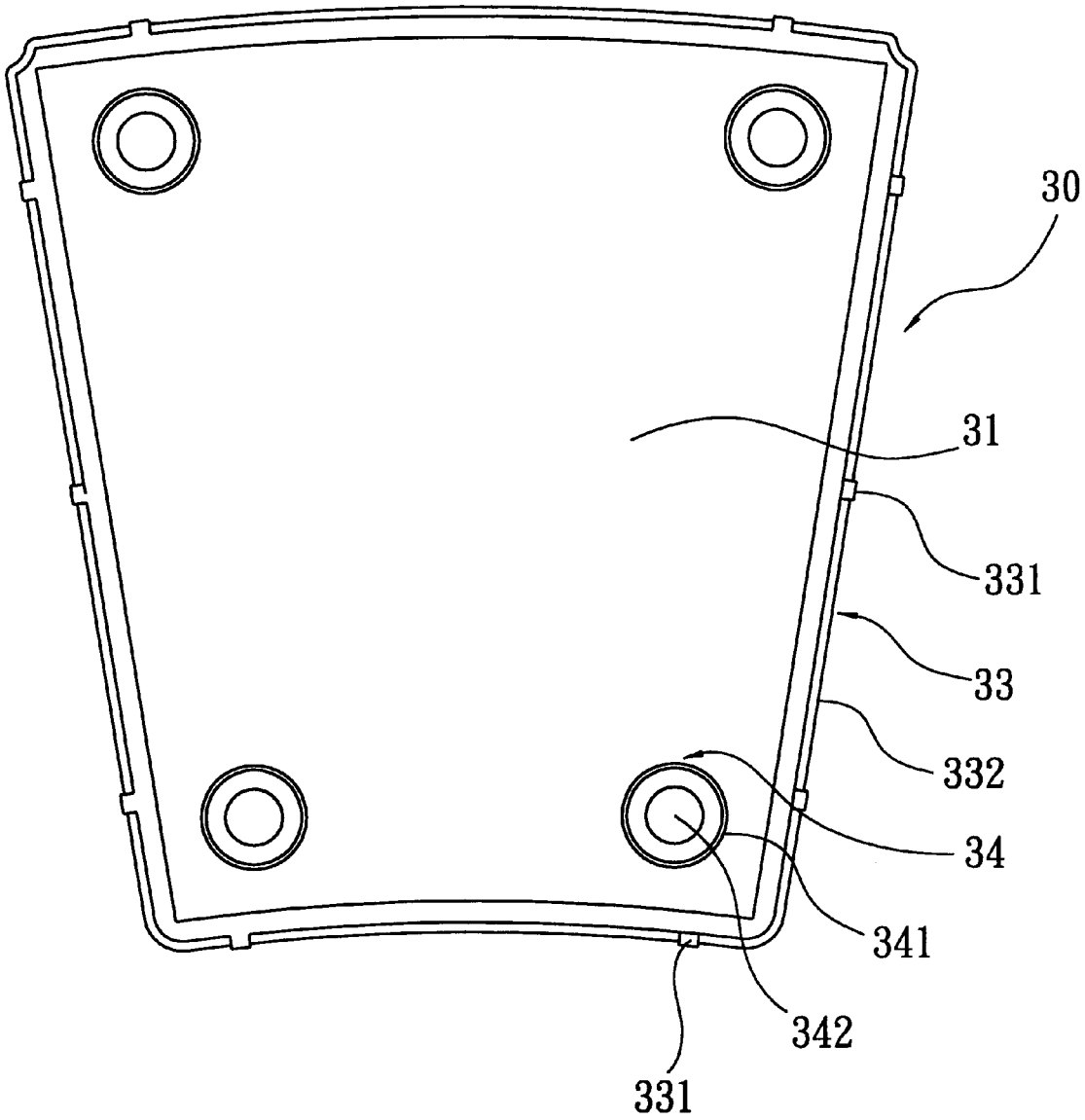
FIG. 3 is a bottom plan view of the target block structure of an electronic dartboard in accordance with the first embodiment of the present invention.
Figure 4:
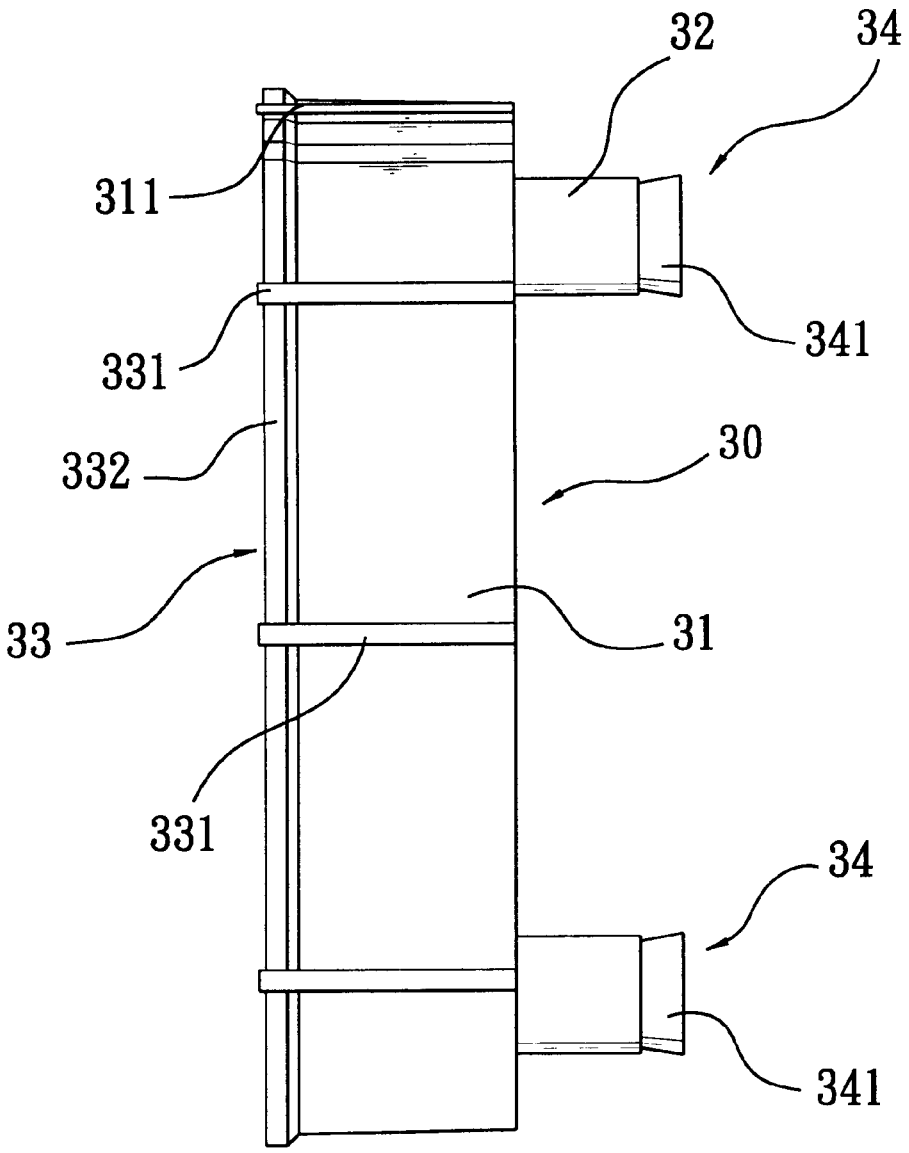
FIG. 4 is a side plan view of the target block structure of an electronic dartboard in accordance with the first embodiment of the present invention.

Referring to the drawings and initially to FIGS. 2–5, a target block structure of an electronic dartboard in accordance with a first embodiment of the present invention comprises a target frame 20, a plurality of target blocks 30, a plurality of electronic sensing members 40, and a back plate 50.

The target block 30 is mounted in the target frame 20, and includes a body 31 which may be formed by hard plastic material, such as PE plastic, for increasing the structural strength of the target block 30. The front face of the body 31 is formed with multiple dart holes 311 for receiving the darts. The bottom of the body 31 is protruded with multiple trigger columns 32 made of hard material that may co-operate with the electronic sensing member 40 of the electronic dartboard to perform a trigger action when the target block 30 is hit.

When the body is formed by the plastic material and is not hardened completely, a soft material is coated on the peripheral wall of the body 31 to form a soft cushioning structure 33 that is integrally formed with the target block 30. The soft cushioning structure 33 includes a plurality of longitudinal cushioning ribs 331 that are directly formed on the side wall of the target block 30 to mate with the longitudinal wall face of the target frame 20. The end portion of the longitudinal cushioning rib 331 protrudes from the front face of the body 31 of the target block 30. The end portion of the trigger column 32 of the target block 30 is formed with a soft column leg 34 which has an outside formed with an annular wall 341, and an inside formed with a trigger point 342.

Figure 5:
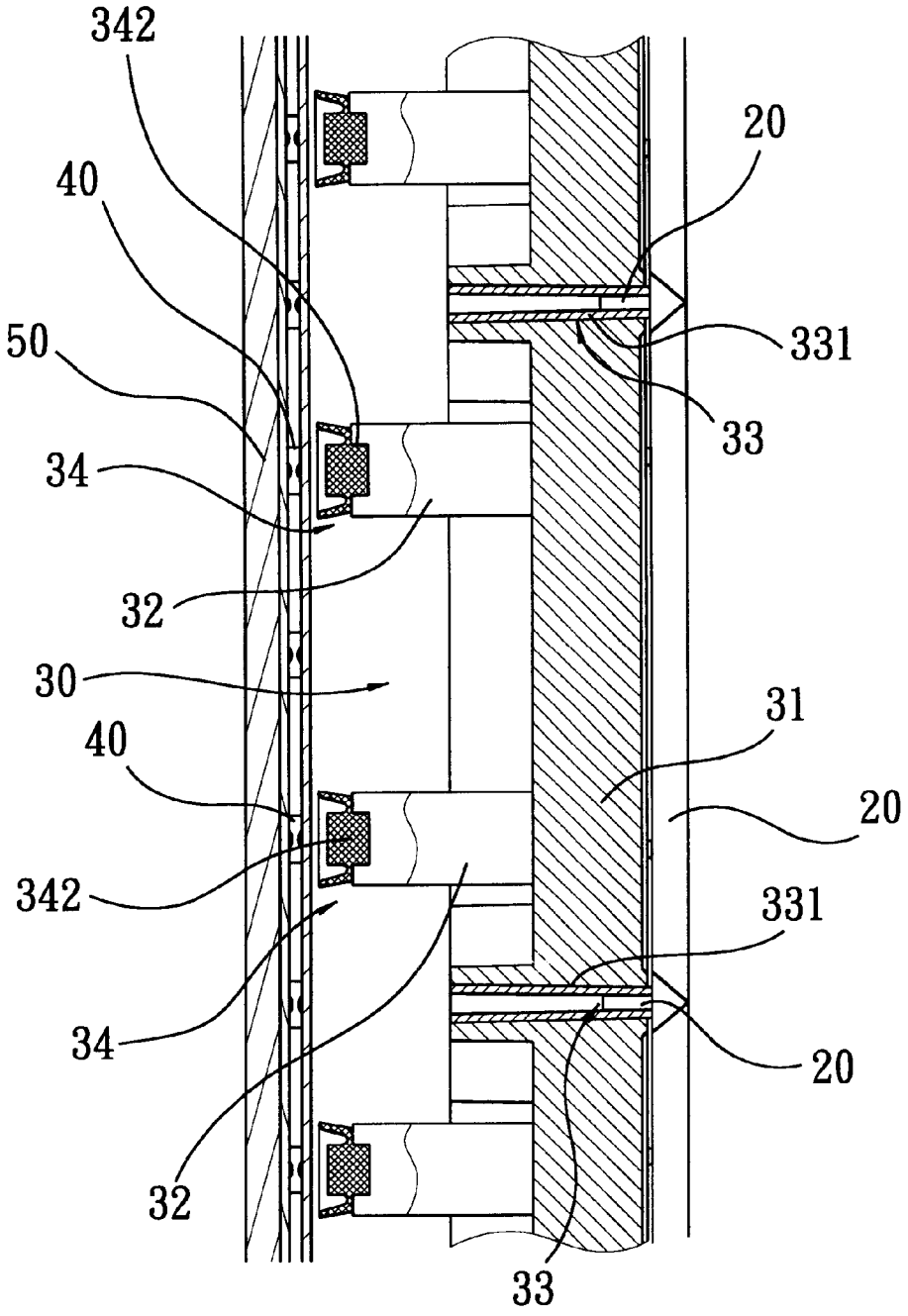
FIG. 5 is a cross-sectional view of the target block structure of an electronic dartboard in accordance with the first embodiment of the present invention.

After the target block 30 is fitted in the target frame 20, each of the cushioning ribs 331 of the soft cushioning structure 33 contacts the target frame 20, the protruding end portion of the cushioning rib 331 contacts the rib of the target frame 20, and the column leg 34 of the target block 30 may contact the electronic sensing member 40 as shown in FIG. 5.

The soft cushioning structure 33 may include a cushioning wall 332 which is directly formed on the side wall of the target block 30 to mate with the side wall face of the target frame 20.

Figure 6:
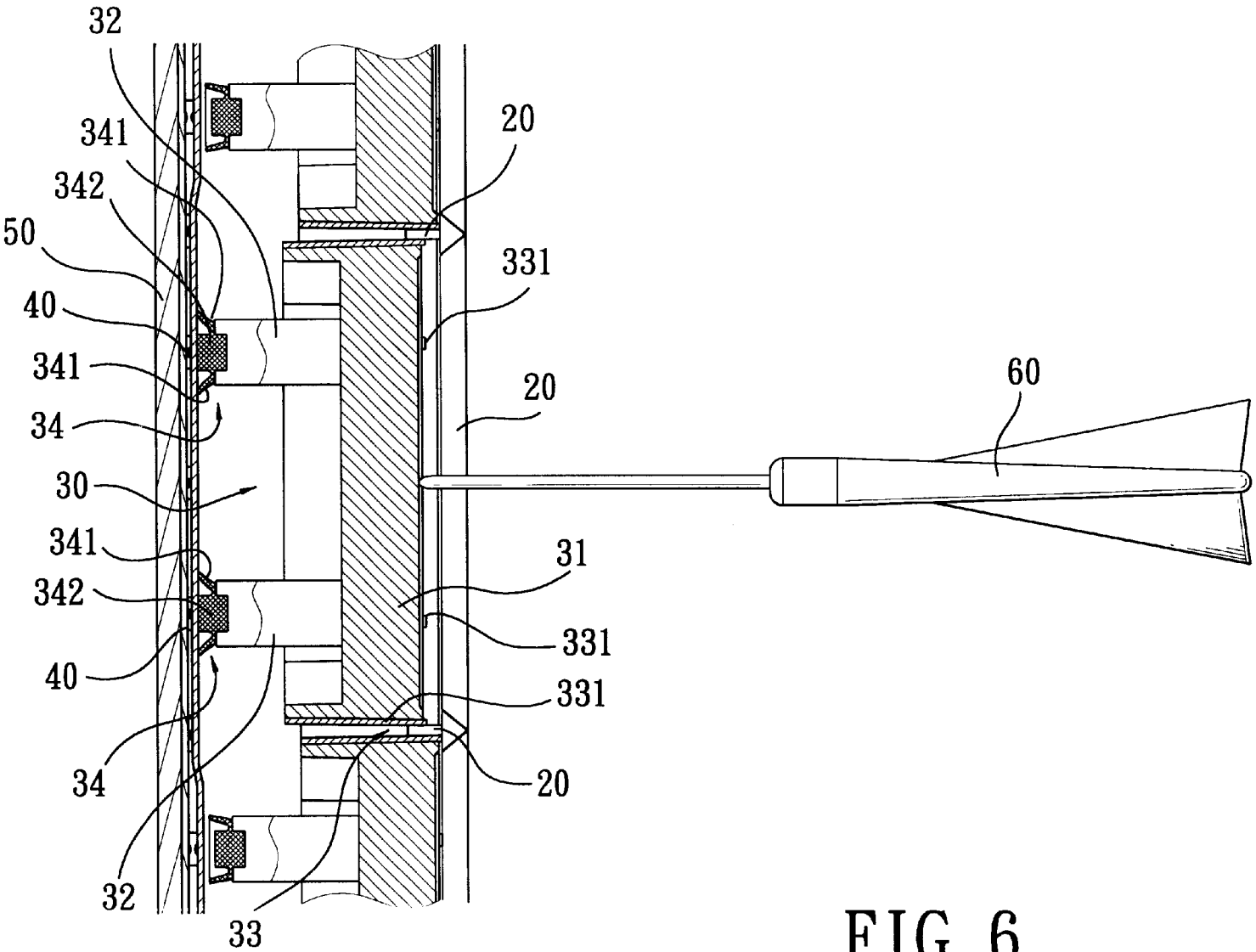
FIG. 6 is a schematic operational view of the target block structure of an electronic dartboard as shown in FIG. 5 in use.

Referring to FIG. 6, when the target block 30 is hit by the dart 60, the target block 30 slides backward by the impact force of the dart 60. During the displacement process of the target block 30, the cushioning rib 331 of the soft cushioning structure 33 contacts the inner wall of the target frame 20, thereby decreasing the contact friction and the impact noise between the target block 30 and the target frame 20 by means of the soft feature of the cushioning ribs 331 of the soft cushioning structure 33. The target block 30 may slide backward from the position as shown in FIG. 5 to the position as shown in FIG. 6 where the column leg 34 of the trigger column 32 of the target block 30 contacts the electronic sensing member 40 to induce and operate. When the annular wall 341 of the soft column leg 34 contacts the electronic sensing member 40, the annular wall 341 may be deformed (expanded outward) by the impact, thereby reducing the impact force, so that when the trigger point 342 in the annular wall 341 contacts the electronic sensing member 40, the impact force has been greatly decreased, thereby preventing incurring the noise.

Figure 7:
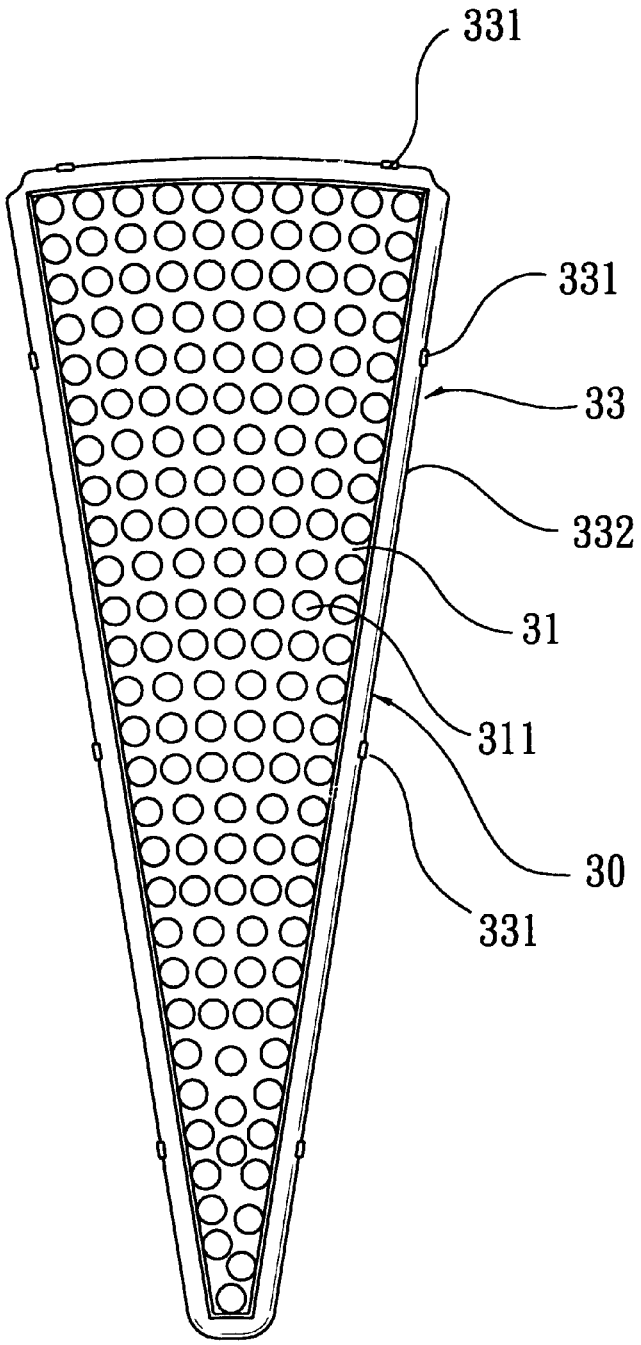
FIG. 7 is a top plan view of a target block structure of an electronic dartboard in accordance with another embodiment of the present invention.
Figure 8:
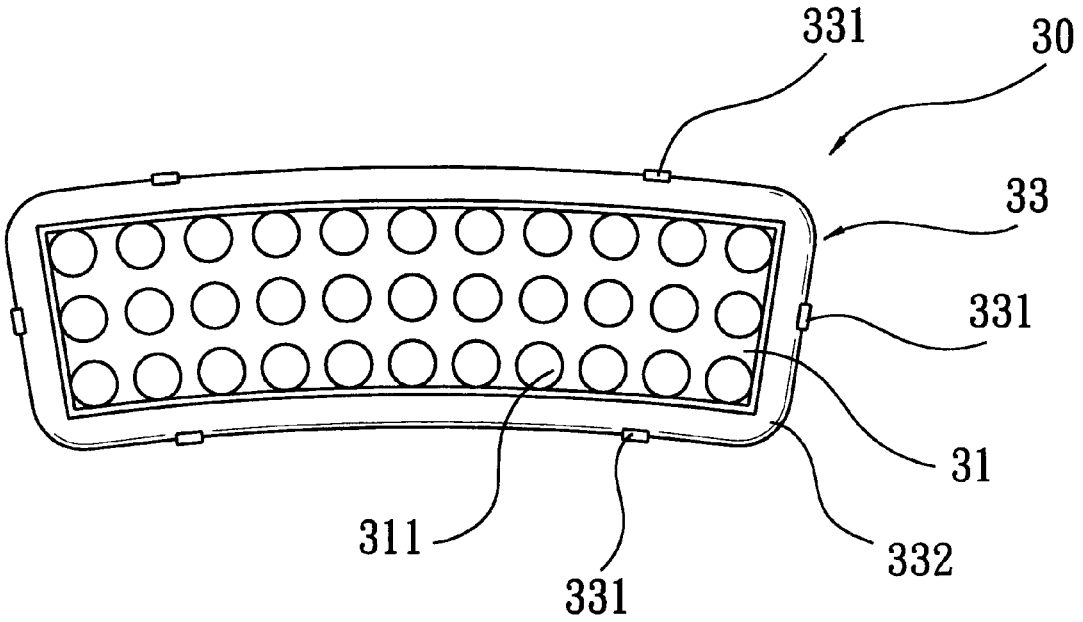
FIG. 8 is a top plan view of a target block structure of an electronic dartboard in accordance with another embodiment of the present invention.
Figure 9:
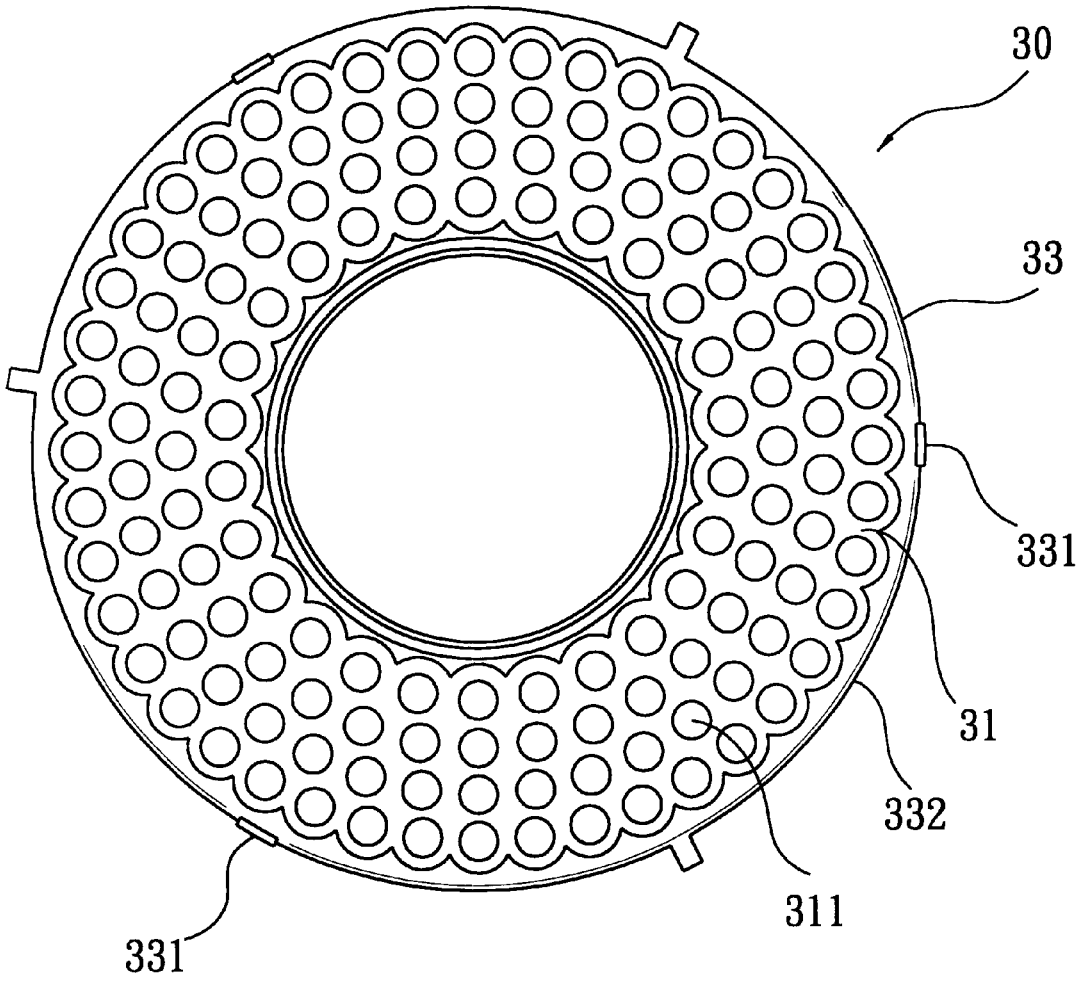
FIG. 9 is a top plan view of a target block structure of an electronic dartboard in accordance with another embodiment of the present invention.

Accordingly, in accordance with the present invention, the soft cushioning structure 33 is integrally formed on the outside of the hard body 31 of the target block 30, so that when the target block 30 is fitted with the target frame 20, the impact force and the friction noise may be greatly reduced, without having to change the original dartboard structure and without having to increase the fitting parts. In addition, the soft cushioning structure 33, the cushioning ribs 331, and the cushioning wall 332 may be available to different kinds of target blocks. For example, the target block 30 may have a sector shape as shown in FIG. 7, have a crescent shape as shown in FIG. 8, or may have an annular shape as shown in FIG. 9.

Figure 10:
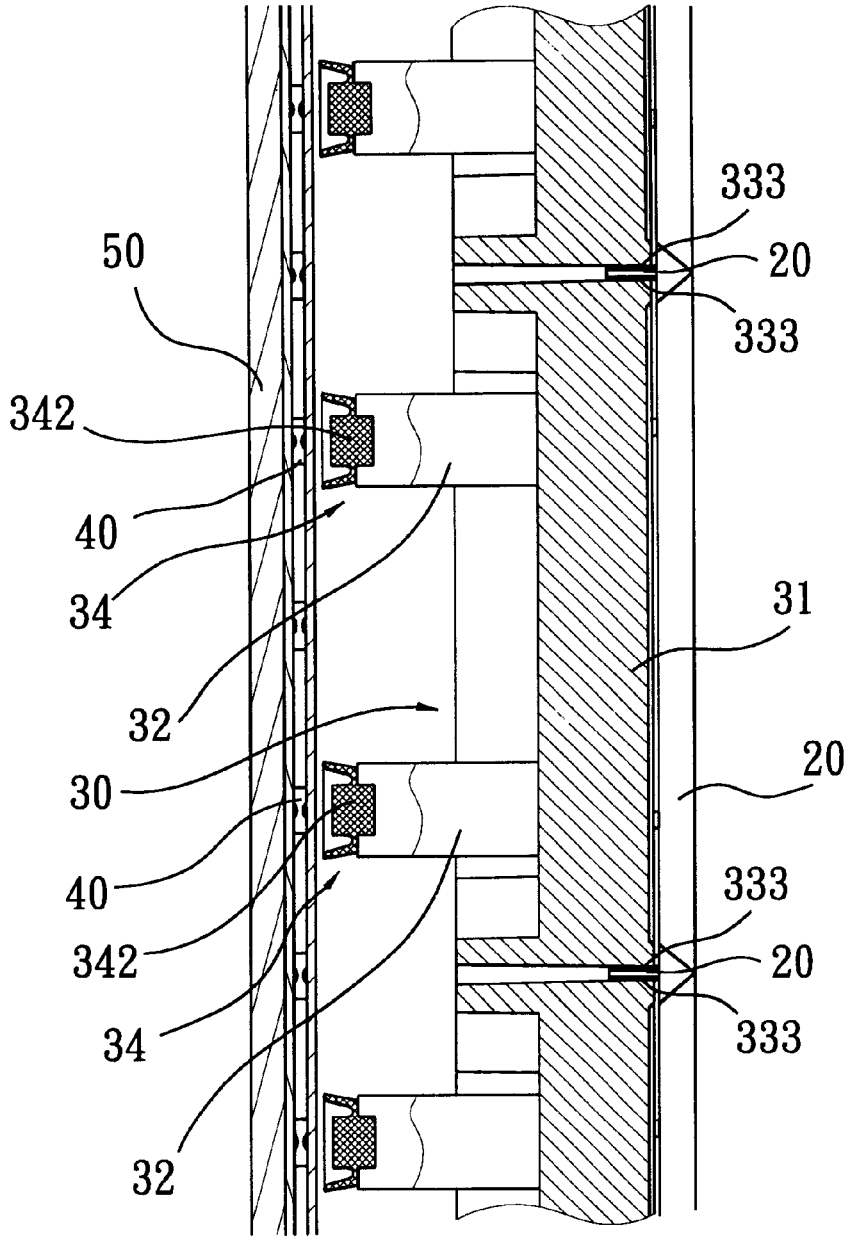
FIG. 10 is a cross-sectional view of a target block structure of an electronic dartboard in accordance with a second embodiment of the present invention.

Referring to FIG. 10, in accordance with a second embodiment of the present invention, the soft cushioning structure 33 is directly formed on the peripheral wall of the target frame 20, thereby forming cushioning bars 333 to mate with the side wall of the target block 30. Thus, when the target block 30 is hit by the dart to slide in the target frame 20, the soft cushioning structure 33 formed on the target frame 20 may efficiently decrease the impact force and the friction noise.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A target block structure of an electronic dartboard, comprising:

a target block, having a body for shooting of a dart, said body having a back face from which protrudes a trigger column; and a soft cushioning structure, directly formed on an outer portion of said target block, to be integrally formed with said target block;

wherein, said target block having said soft cushioning structure is placed in a target frame, thereby achieving vibration cushioning and reducing effects.

2. The target block structure of an electronic dartboard in accordance with claim 1, wherein said soft cushioning structure includes a plurality of longitudinal cushioning ribs that are directly formed on a side wall of said target block, to mate with a longitudinal wall face of said target frame.

3. The target block structure of an electronic dartboard in accordance with claim 2, wherein said longitudinal cushioning rib has an end portion protruding from an end face of said body of said target block, to mate with a rib of said target frame.

4. The target block structure of an electronic dartboard in accordance with claim 1, wherein said soft cushioning structure includes a cushioning wall which is directly formed on a side wall of said target block to mate with a side wall face of said target frame.

5. The target block structure of an electronic dartboard in accordance with claim 1, wherein said trigger column has an end portion formed with a soft column leg for providing a cushioning effect to said target block when said target block is displaced.

6. The target block structure of an electronic dartboard in accordance with claim 5, wherein said column leg has an outside formed with an annular wall that may be deformed by an impact force for cushioning said impact force, and an inside formed with a trigger point that may be operated by contact.

7. The target block structure of an electronic dartboard in accordance with claim 1, wherein said soft cushioning structure is directly formed on a peripheral wall of said target frame, thereby forming cushioning bars to mate with a side wall of said target block.

* * * * *